United States Patent [19]

Paulmier

[11] 4,038,955

[45] Aug. 2, 1977

[54] AUTOMATIC CHOKE SYSTEMS FOR CARBURETORS

[75] Inventor: Claude Paulmier, Creteil, France

[73] Assignee: Societe Industrielle de Brevets et d'Etudes S.I.B.E., France

[21] Appl. No.: 556,388

[22] Filed: Mar. 7, 1975

[30] Foreign Application Priority Data

Mar. 19, 1974 France ..... 74.09330
May 17, 1974 France ..... 74.17360

[51] Int. Cl.[2] ..... F02M 1/10; F02M 23/04; F02D 11/08

[52] U.S. Cl. ..... 123/119 F; 261/39 R; 261/39 B

[58] Field of Search ..... 123/119 F; 261/39 R, 261/39 A, 39 C, 39 B, 39 E; 219/206, 207, 504, 505

[56] References Cited

U.S. PATENT DOCUMENTS

| | | | |
|---|---|---|---|
| 3,699,937 | 10/1972 | De Petris | 123/119 F |
| 3,752,133 | 8/1973 | Irish | 123/119 F |
| 3,806,854 | 4/1974 | Armstrong | 123/119 F |

*Primary Examiner*—Ronald H. Lazarus
*Attorney, Agent, or Firm*—Stevens, Davis, Miller & Mosher

[57] ABSTRACT

An automatic cold start and warmup system for an internal combustion engine carburetor comprises a coiled bimetallic spring element actuating a choke valve mounted across the induction passage of the carburetor to control air flow therethrough. Two PTC heating resistors are located in heat-transfer relation with the bimetallic element, have different switching temperatures and are connected in series with a source. A switch closes above a predetermined temperature level of the engine and short-circuits the resistor having the lower switching temperature.

9 Claims, 6 Drawing Figures

AUTOMATIC CHOKE SYSTEMS FOR CARBURETORS

BACKGROUND OF THE INVENTION

The invention relates to carburetors for internal combustion engines and more particularly to automatic cold-start and warmup systems therefor.

Automatic cold-start systems are known wherein a temperature-sensitive element in the form of a bimetal coil experiences the temperature of a positive temperature coefficient (PTC) resistor and is coupled with the carburetor choke valve (U.S. Pat. No. 3,752,133).

For fully satisfactory operation of a cold-start system, the opening of the choke valve should occur in successive steps; first a fast and partial opening of the choke valve immediately subsequent to engine starting so as to lean rapidly the very rich mixture necessary for cold cranking, then a much slower opening during a second phase to keep the mixture at the richness necessary for satisfactory operation of the engine during warmup, and finally a fast opening to maximum opening to cut out enrichment once the engine has warmed up close to its normal temperature.

This object cannot be achieved by providing several PTC resistors in parallel relation, one of which is energized at the starting of the engine and at least another of which is energized by a switch which closes when the engine reaches a predetermined temperature.

It would probably be possible to achieve that result by using a number of resistors to heat the temperature-sensitive element, such resistors being controlled by automatic selection mechanisms, but such mechanisms would be expensive and subject to wear. It is an object of the invention to provide an automatic cold start and warmup system which is improved with respect to the prior art system.

SUMMARY OF THE INVENTION

For that purpose, there is provided an automatic control system comprising a temperature-responsive element, such as a bimetallic coil, connected to a carburetor choke valve and heated by at least two positive temperature coefficient (PTC) electrical resistors. The resistors have different switching temperatures and are permanently connected in series with one another electrically, and the system comprises a switch for shortcircuiting the lower switching temperature resistor, such switch closing automatically at and above a predetermined temperature.

The switch typically is maintained at a temperature representative of engine temperature, which can either be the engine temperature itself or a temperature varying in dependence upon engine temperature.

The two PTC resistors can have values of the same order before switching, although this is not essential. The two resistors can be carried on a single radiant plate made of material which is a good heat conductor and is disposed opposite the bimetallic coil. The switch can be placed on the engine crank case so as to be heated to engine temperature. The switch can be a heat-sensitive contact or a negative temperature coefficient (NTC) resistor, which has the advantage of suffering neither from wear nor from contact oxidation.

The invention will be better understood from the following description of systems which are exemplary and non-limitative embodiments of the invention. The description refers to the accompanying drawings.

SHORT DESCRIPTION OF THE DRAWINGS

Figure 1:
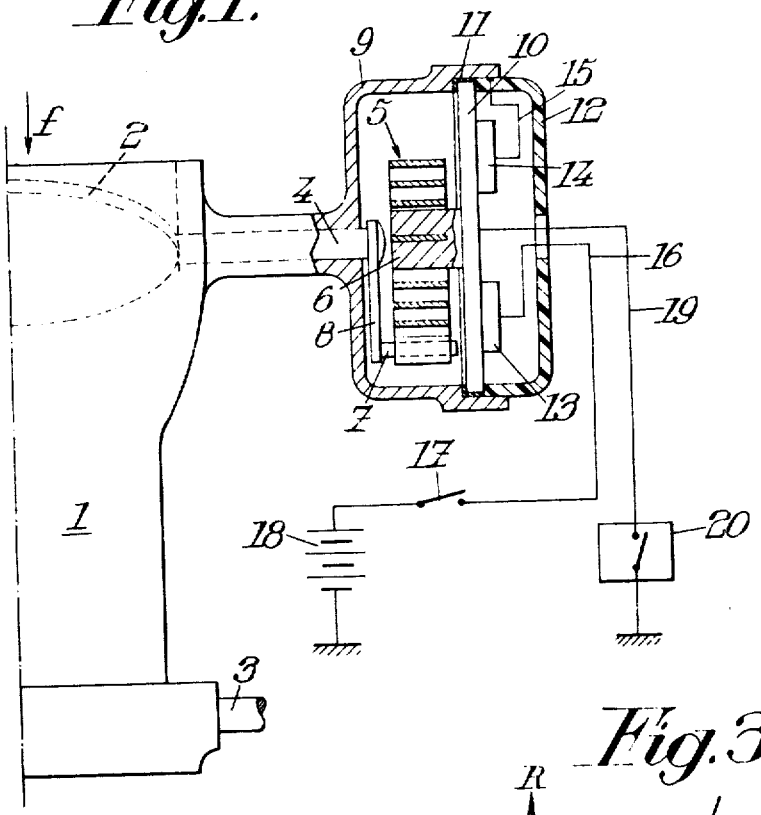
FIG. 1 is as view in elevation, and partly in section, of part of a carburetor having the starting system.
Figure 4:
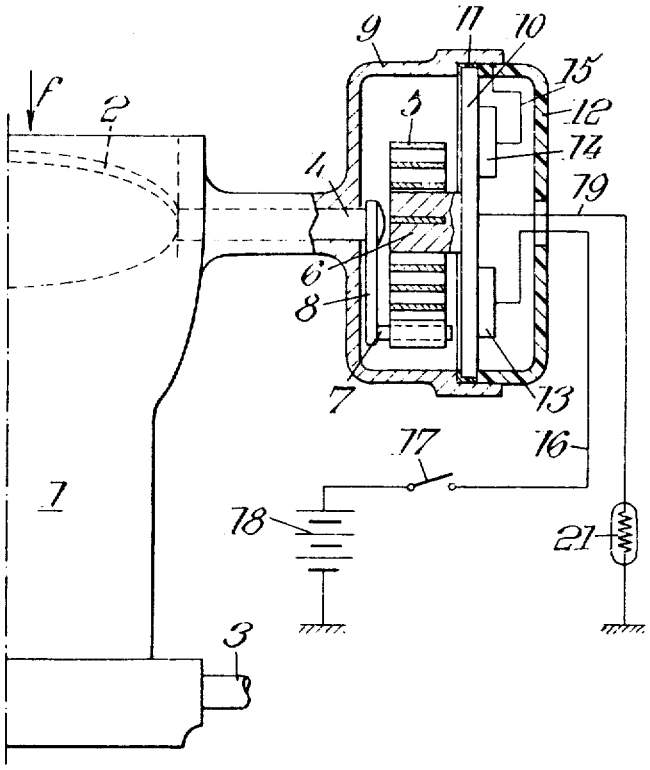
Figure 5:
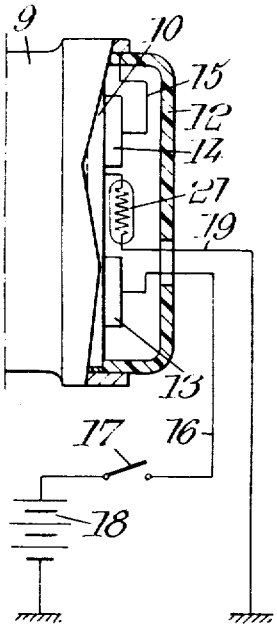
Figure 6:
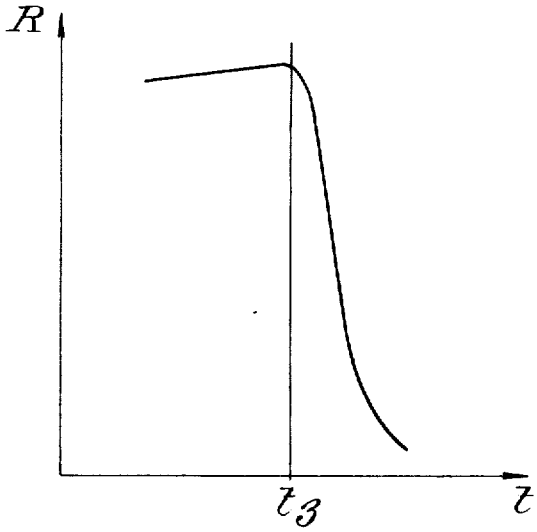

FIG. 4 similar to FIG. 1, shows a carburetor having a starting device which is a variant of what is shown in FIG. 1 and in which the switch is an NTC resistor which experiences engine temperature;

FIG. 5 is a partial view of a starting system which is a variant of the one shown in FIG. 4, and FIG. 6 is a diagram in which the variation of the value R of the NTC resistor forming the switch is plotted against the temperature t acting on the switch.

DESCRIPTION OF PREFERRED EMBODIMENTS

The carburetor shown in FIG. 1 comprises an induction passage 1 into which conventional carburetor jetting ports (not shown) open at a location upstream of a throttle element secured to a spindle 3 connected to a driven actuated accelerator pedal or treadle.

The starting system comprises a choke valve 2 disposed on a rotating drive spindle 4. As a rule, valve or flap 2 is unbalance mounted so that the air flowing through pipe 1 in the direction indicated by arrow *f* tends to open valve 2. The automatic control system comprises a temperature-sensitive element which in the embodiment shown is a bimetallic coil 5 having its inner end rigidly secured to a stationary spindle 6, while its outer end drives the spindle 4 in the appropriate direction by way of a pin 7 made of an electrically insulating material and by way of a crank 8. Coil 5 is disposed in a compartment or chamber bounded by a casing 9 and by a radiant metal plate 10. In the embodiment of FIG. 1, plate 10 is electrically insulated from casing 9, which is grounded, by an insulating washer 11. The bimetallic coil 5 is disposed in close proximity to the surfaces of plate 10 and receives radiant heat therefrom when the plate 10 is heated to a high temperature, coil 5 also receiving the heat conducted through the spindle 6 rigidly secured to plate 10.

Figure 3:
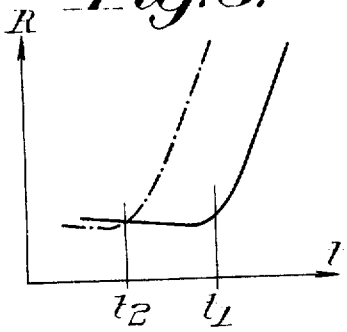
FIG. 3 is a diagram in which variations in the value R of the resistors are plotted against the temperature *t;*

The plate surface remote from the surface opposite the coil 5 carries heating means in the form of two PTC resistors 13, 14 protected by an insulating cover 12. PTC resistors have an internal resistance whose variation in dependence upon temperature is as indicated by the solid-line and chain-dotted line curves in FIG. 3. There is an abrupt increase in the resistance R beyond a temperature level called the switching temperature. The resistor 13 is chosen to have a switching temperature t1 appreciably above the switching temperature $t_2$ of the resistor 14, both switching temperatures being above the ambient atmospheric temperatures found in normal engine operation conditions. Such resistors can be inter alia in the form of ceramic pellets or chips containing barium titanate.

That surface of resistor 14 remote from the surface which is secured (e.g. by cold welding) to the plate 10 is grounded via a conductor 15. That surface of the resistor 13 which is remote from the surface secured to plate 10 is connected, by an insulated wire 16 and a switch 17 (which is open at rest and which closes when the engine is started), to an electric power supply 18 which can be the battery of the vehicle having the engine. The plate 10, which is insulated from the grounded casing 9, is electrically connected by way of a conductor 19 to a switch 20 which is sensitive to engine temperature and which, upon such temperature exceeding a predetermined value of e.g. approximately 70° C, closes and thus grounds plate 10. The contact can inter alia be mounted on the engine crank case wall so as to experience the engine temperature.

The operation of the system is apparent from the previous description and will therefore be only briefly described.

At cold starting, at a temperature below the temperature at which contact or switch 20 closes, current flows consecutively through the resistor 13, plate 10 and resistor 14. If as a simplification it is assumed that the resistors 13 and 14 both have substantially the same value $r$, the power dissipated is approximately $V^2/2r$ (V denoting the supply voltage). The temperature of the plate 10 and of the coil 5 rises rapidly. The coil 5 tends to uncoil and in so doing rotates the choke valve 2 so that the opening angle $\alpha$ thereof increases.

When plate 10 reaches the switch temperature $t_2$ of resistor 14, the value thereof increases abruptly and there is also a considerable decrease in heat dissipation. Of course, if the temperature of the plate tends to drop below the switch temperature $t_2$, current starts to flow again; this feature provides a temperature control.

The engine therefore runs with the valve 2 partly open and gradually warms up. When the temperature $t_3$ at which the contact 20 operates has been reached, contact 20 closes at the time $T_1$ (FIG. 2) and so shortcircuits resistor 14. Resistor 13 is grounded and dissipates a power of the order of $v^2/r$. The temperature of the resistor 13 and of the radiant plate 10 rise again and the coil 5 tends to uncoil and further increase the opening of valve 2. The value of resistor 13 increases considerably upon its switch temperature $t_1$ being reached (FIG. 3), whereafter there is automatic control of the temperature of plate 10 and therefore of coil 5. This controlled temperature is so chosen that the valve 2 is fully open at such temperature.

Clearly, therefore, there is a rapid cranking open of the choke valve, followed by a slowly increasing opening, followed by rapid final-stage opening to the fully opened position. This sequence of steps gives much better results than an even opening, more particularly in the case of air-cooled engines. It would be impossible to achieve a comparable pattern of choke valve opening by means of parallel-connected PTC resistors in the manner known in the prior art.

Figure 2:
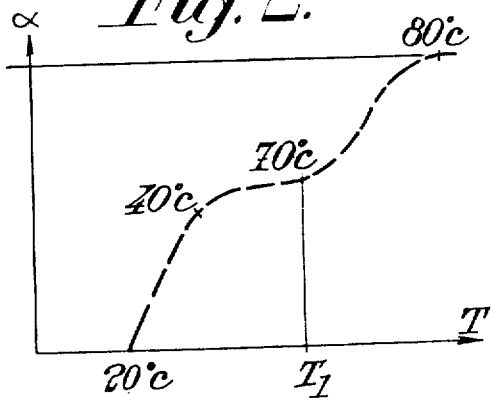
FIG. 2 is a diagram in which variations of the coke valve opening angle $\alpha$ are plotted against the time T.

As an example, satisfactory results were obtained by using PTC resistors and a switch such that engine temperatures during opening of the choke valve were approximately as shown in FIG. 2.

If an engine having such a carburetor is started while hot, the contact 20 is closed so that the plate 10 is immediately heated at full power $V^2/r$ up to the temperature $t_1$, i.e. up to full opening of the choke valve. Clearly, the system is very simple and compact and is a simple means of producing a temperaturedependent opening of the choke valve such that satisfactory starting and satisfactory warmup running are achieved without excessive enrichment of the engine mixture.

In the embodiment shown in FIGS. 4 and 5 (where elements shown in FIG. 1 have the same reference numbers) the temperature-sensitive switch is a NTC resistor 21. Such a resistor acts, of course, as a heat-sensitive switch. As can be seen in FIG. 6, when its temperature is below a predetermined temperature $t_3$, its resistance R is very high and is virtually equivalent to the absence of any electrical connection between conductor 19 and ground. When its temperature exceeds the point $t_3$, its resistance R drops rapidly to a very low value and becomes virtually equivalent to a direct electrical connection between conductor 19 and earth. Resistors of this kind are known more particularly in the form of resistors embodied by high-temperature-sintered oxides.

In the embodiment shown in FIG. 4, the NTC resistor 21 is heated to engine temperature; accordingly, it can be in contact with the engine crank case or associated with the engine coolant or lubricant. In FIG. 5, the resistor 21 is disposed below the cover 12 so as to experience a temperature representative of engine temperature.

The system operates very similarly to the one described with reference to FIG. 1. The value R of resistor 21 decreases abruptly when the temperature reaches a value $t_3$ which is chosen to correspond to a predetermined engine temperature, e.g. 70° C, so that the PTC resistor 14 is then substantially short-circuited and the resistor 13 is on full-power energization, whether or not the resistor 14 is at a temperature above its switch temperature.

The invention can of course be varied in many ways, more particularly as regards the embodiment of the temperature-sensitive element moving the choke valve and as regards the embodiment of the choke valve. Such variants and any other equivalent variants fall of course under this invention.

I claim:

1. An automatic cold start and warmup system for use in a carburetor having an air introduction passage, comprising a choke valve mounted across the induction passage to control air flow therethrough; a temperature-responsive element connected to said choke valve; means for heating said element including at least first and second positive temperature coefficient (PTC) electrical heating resistors permanently connected in series with one another electrically, said first resistor having a higher switching temperature than said second resistor; and switch means operable above a predetermined temperature level for short-circuiting said second resistor having the lower switching temperature, whereby in sequence from a cold start condition current initially flows through said first and second resistors in series to effect rapid opening of said choke valve, the switching temperature of said second resistor is exceeded producing a decrease in the rate of opening of said choke valve, said switch means closes short-circuiting said second resistor resulting in an increase in the rate of opening of said choke valve and the switching temperature of said first resistor is exceeded at substantially full opening of said choke valve.

2. A system according to claim 1, comprising two resistors having substantially the same value under their respective switching temperatures.

3. A system according to claim 1, wherein the resistors are carried on a radiant plate made of heat conducting material disposed substantially parallel to the temperature-responsive element.

4. A system according to claim 3, wherein said element is a coiled bimetallic spring element.

5. A system according to claim 1, wherein the short-circuiting switch means is a thermostatic contact subjected to a temperature representative of the temperature of an engine provided with the carburetor.

6. A system according to claim 1, wherein the switch means is a negative temperature coefficient (NTC) resistor which is subjected to a temperature representative of the temperature of an engine provided with the carburetor.

7. A system according to claim 6, wherein said switch means is carried by the engine crank case.

8. A system according to claim 6, wherein said switch means is in heat-transfer relation with the engine coolant.

9. A system according to claim 6, wherein the NTC resistor is disposed in a casing which also contains said PTC resistors.

* * * * *